US006825154B1

(12) United States Patent
Holt

(10) Patent No.: US 6,825,154 B1
(45) Date of Patent: Nov. 30, 2004

(54) CRYSTAL FORMATION INHIBITION IN LUBRICATING COMPOSITIONS

(75) Inventor: David Gary Lawton Holt, Medford, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/069,321

(22) PCT Filed: Aug. 11, 2000

(86) PCT No.: PCT/EP00/07910

§ 371 (c)(1),
(2), (4) Date: Jul. 22, 2002

(87) PCT Pub. No.: WO01/12762

PCT Pub. Date: Feb. 22, 2001

(30) Foreign Application Priority Data

Aug. 17, 1999 (GB) ..... 9919490

(51) Int. Cl.[7] ..... C10M 141/10

(52) U.S. Cl. ..... 508/442; 508/306; 508/441; 508/506; 508/512; 508/584; 508/585

(58) Field of Search ..... 508/441, 512, 508/485

(56) References Cited

U.S. PATENT DOCUMENTS

| | | | | | |
|---|---|---|---|---|---|
| 3,965,017 | A | * | 6/1976 | Burnop et al. | 508/306 |
| 4,118,331 | A | * | 10/1978 | Jahnke | 508/306 |
| 5,523,007 | A | * | 6/1996 | Kristen et al. | 508/297 |
| 5,972,852 | A | * | 10/1999 | Robson | 508/306 |
| 6,689,726 | B1 | * | 2/2004 | Holt | 508/442 |

* cited by examiner

*Primary Examiner*—Ellen M McAvoy
(74) *Attorney, Agent, or Firm*—Joseph J. Allocca; Mark D. Marin

(57) ABSTRACT

Lubricating oil formulations comprising base oil, sulfur-phosphorous anti-wear/extreme pressure agents and hindered phenol antioxidants which anti-wear/extreme-pressure agents and hindered phenolic antioxidants are prone to crystal formation wherein the base oil is characterized as having a saturates content of less than 99% are stabilized against crystal formation by the addition of a minor amount of a high molecular weight di- or polycarboxylic acid anhydride, or mixture thereof.

28 Claims, No Drawings

CRYSTAL FORMATION INHIBITION IN LUBRICATING COMPOSITIONS

This invention relates to lubricating oil based on base stocks having less than 99 wt % saturates content and containing one or more sulfur-phosphorus containing anti-wear/extreme pressure additives and one or more hindered phenol anti oxidants which combination are prone to crystal formation, wherein the formation of crystals is reduced or eliminated by the use of a crystallization suppressant.

Lubricating oils containing various antioxidants or esters or fatty acid amides or sulfur-phosphorus additives in combination with phenols are known in the literature.

U.S. Pat. No. 5,167,844 is directed to a formulation comprising a base oil, at least one sulfur phosphorus containing compound, at least one amine and at least one hindered phenol.

JP 07034078 is directed to a hydraulic oil comprising mineral oil with an aromatic content of up to 1.5 wt % and a phenolic and aminic anti-oxidant, an alkenyl succinic acid imide rust inhibitor and a phosphoric acid type anti wear agent.

U.S. Pat. No. 5,580,483 is directed for lubricating a refrigeration system compressor using a break-in lubricating oil which is an ester type oil. Additionally an adipate, phthalate, azelate, sebacate, trinellitate can also be present as well as tri hydrocarbyl phosphate, corrosion inhibitors such as alkali and/or alkaline earth metal sulfonate, antioxidants such as aminic or phenolic antioxidants and metal deactivators such as triazoles.

WO 97/14776 is directed to hydraulic oils comprising base oils combined with an amine antioxidant, a phenolic antioxidant, a phosphate ester and a fatty acid amide and/or polyhydric alcohol ester.

U.S. Pat. No. 5,773,393 is directed to a composition comprising at least 70 wt % oil of lubricating viscosity and an amount effective to inhibit metal corrosion of a soluble additive comprising (a) at least one amide compound of a mono- or polycarboxylic acid or reactive derivative thereof and (b) at least 0.5 equivalents of at least one primary or secondary amine per mole of amide provided that when (a) is an amide of a dicarboxylic acid and the amine is an alkanol amine the mixture contains more than 0.5 equivalent of the amine (b) per equivalent of the amide.

The present invention is directed to a lubricating oil formulation having a reduced potential for the formation of crystals comprising a major amount of a lubricating oil base stock having less than about 99 wt % saturates content, preferably less than about 98 wt % saturates content, and a minor amount of additives comprising a mixture of sulfur-phosphorus containing anti-wear/extreme pressure additive, hindered phenol antioxidant and one or more high molecular weight di-, or polycarboxylic acid, anhydride or mixture thereof such as polyolefin succinic acid/anhydride, and to a method for reducing crystal formation in lubricating oil formulations comprising base oil having less than about 99 wt % saturates content, preferably less than about 98 wt % saturates content, and containing sulfur phosphorus anti-wear/extreme pressure additive and hindered phenolic anti-oxidant wherein the crystals are attributed to the interaction between the sulfur phosphorus containing anti-wear/extreme pressure agent and the hindered phenol by adding to said lubricating oil a minor effective amount of one or more high molecular weight di- or polycarboxylic acid or anhydride such as polyolefin succinic acid/poly olefin succinic anhydride and/or mixtures thereof.

The lubricating base oil is any oil of lubricating oil viscosity having less than about 99 wt % saturates content, preferably less than about 98 wt % saturates content.

Lubricating oils meeting this criterion are any natural mineral or petroleum based lubricating oils derived from crude oil, tar sands, shale oil, etc., such that they contain a quantity of unsaturation resulting in a saturates content of less than of 99%, or a mixture of natural mineral or petroleum based lubricating oils in combination with a base oil or oils having a saturates content of greater than 99 wt %, e.g. hydrocarbon oils such as white oils and/or severely hydrotreated, hydrocracked mineral oils, or synthetic oils such as poly alpha olefins, esters, isomerized wax or isomerized Fischer-Tropsch wax, the combination or mixture of such oils being characterized as having less than about 99 wt % saturates. Saturates content, for the purposes of this specification, is a measure of the absence of aromatic species, and was determined by high pressure liquid chromatography (HPLC) according to method IP 368, except where otherwise expressly indicated.

The lubricating oil base stocks useful in the present invention have the typical lubricating oil viscosity, usually possessing kinematic viscosities in the range of about 1.5 to 500 $mm^2/s$ at 100° C., preferably 5 to 120 $mm^2/s$ at 100° C.

Mineral or petroleum based lubricating oil base stocks can be derived from paraffinic, naphthenic and mixed base crudes. Conventional refinery techniques include distillation, solvent and/or catalytic dewaxing, solvent extraction, hydrofinishing, hydrocracking, vis breaking, deasphalting, etc.

Synthetic lubricating oils that can be used include esters of di- and tri-basic acids, reacted with linear or branched aliphatic alcohols such as $C_6$–$C_{15}$ alcohols, such as di-2-ethylhexyl sebacate, phthatic ester esters of glycols such as $C_{13}$ oxo acid diester or tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g., alkylate bottoms from the alkylation of benzene with tetrapropylene, or the copolymers of ethylene and propylene; silicone oils, e.g., ethyl phenyl polysiloxanes, methyl polysiloxanes, etc.; polyglycol oils, e.g., those obtained by condensing butyl alcohol with propylene oxide; carbonate esters, e.g., the product of reacting $C_6$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups.

Other suitable oils are the polyol ester oils made by reacting an aliphatic polyol with carboxylic acid. Aliphatic polyols contain from 4 to 15 carbon atoms and has from 2 to 8 esterifiable hydroxyl groups. Examples of polyols are triimethylolpropane, pentaerthritol, dipentaerythritol, neopentyl glycol, tripentaerythritol and mixtures thereof. The carboxylic acid reactant is selected from aliphatic monocarboxylic acid or mixtures of aliphatic mono carboxylic acids or mixtures of aliphatic mono- and di-carboxylic acids. The carboxylic acids contain 4 to 12 carbons and include straight and branched chain carboxylic acids.

Included in the group of synthetic oils are those recovered from tar sands, shale oil, light hydrocarbons produced via, for example, the Fischer-Tropsch process for converting synthesis gas (CO and hydrogen) into hydro-carbons, wax isomerate oils produced by the catalytic hydroisomerization of natural petroleum waxes (i.e., slack wax) or synthetic waxes (i.e., Fischer-Tropsch waxes) or mixtures of such waxes. See U.S. Pat. No. 5,059,299 and U.S. Pat. No. 5,158,671 for description of wax isomerization and the oils produced thereby. Other synthetic oils include the polyolefins such as polybutene, polyisobutenes and especially the polyalphaolefins, i.e., fluids formed by the oligomerization of at least one 1-alkane hydrocarbon having from 6 to 20 carbons, preferable 8 to 16 carbons, more preferably 8 to 12 carbons.

Regardless of the source of the oil, for the purposes of the present invention, the lube oil base stock, be it a single oil or a mixture of oils, is characterized as having a saturates content of less than about 99%, preferably less than 98 wt %.

Sulfur-phosphorus containing anti-wear/extreme pressure additives are well known in the industry, and are materials containing both sulfur and phosphorus in the same molecule. For the purpose of the present specification, and appended claims sulfur-phosphorus containing anti wear, extreme pressure additives are those which react with hindered phenols to produce crystals. Those skilled in the formulation art can readily determine without expenditure of inventive effort, whether a particular sulfur-phosphorus containing anti-wear/extreme pressure agent reacts with hindered phenol anti-oxidant to produce crystals. If it does not, it is not within the scope of this invention. Any sulfur-phosphorus containing anti-wear/extreme pressure agent which is found to react with hindered phenol antioxidant to produce crystals in the subject base oil is within this invention and formalities containing such agents and phenolic antioxidants will be beneficially affected is evidenced by reduction on elimination of crystal formation by the addition of the high molecular weigh di- or poly carboyxlic acid, anhydride or mixture thereof, as shown below, provided such carboxylic acid, anhydride or mixture thereof is used in an amount of at least about 0.0013 wt % for each 1 ppm phosphorus attributable to the sulfur-phosphorus containing anti-wear/extreme pressure agent.

Sulfur-phosphorus anti-wear/extreme pressure additives which interact with hindered phenols to produce crystals are exemplified by, but not limited to, materials of the type:

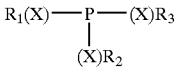

wherein $R_1$, $R_2$ and $R_3$ are independently hydrogen or hydrocarbyl provided at least one is hydrocarbyl so as to render the material oil soluble and X is sulfur.

The hydrocarbyl groups preferably contain form 1 to 40 carbons and are aromatic and/or aliphatic groups and include aryl alkyl and alkaryl and aralkyl and heteroatom substituted aromatic and aliphatic group, the heteroatom substitutents being sulfur, nitrogen or oxygen substitutented as such into the hydrocarbon skeleton or as sulfur, oxygen or nitrogen containing moiety, e.g., —$OR_y$, —SH, —$SO_2H$, —$N(R_y)_2$,—C—$R_xOR_y$,

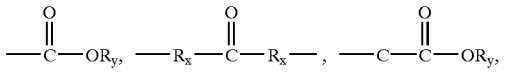

etc., and mixtures thereof substituted onto or into the hydrocarbon backbone, wherein $R_x$ is $C_1$–$C_{20}$ hydrocarbyl or hydrocarbylene group and $R_y$ is hydrogen or a $C_1$–$C_{20}$ hydrocarbyl or hydrocarbylene.

Such sulfur-organo phosphorus containing anti-wear/extreme pressure agent is typically used at a concentration sufficient to provide of from about 2 ppm to 320 ppm phosphorus, preferably 40 ppm to 200 ppm phosphorus, most preferably about 80 ppm to 130 ppm phosphorus.

An example of a sulfur phosphorus anti-wear/extreme pressure additive which has been found to react with hindered phenols to form crystals is a material is 2-ethylhexyl 10-ethyl-4-[[2-[(2 ethylhexyl)-oxyl]-2-oxoethyl]thio]-7-oxo-8-oxa-3,5-dithia-4-phospha tetradecanoate, CAS # 83547-95-9. Based on the name and the CAS number, it is believed this material has the following structure:

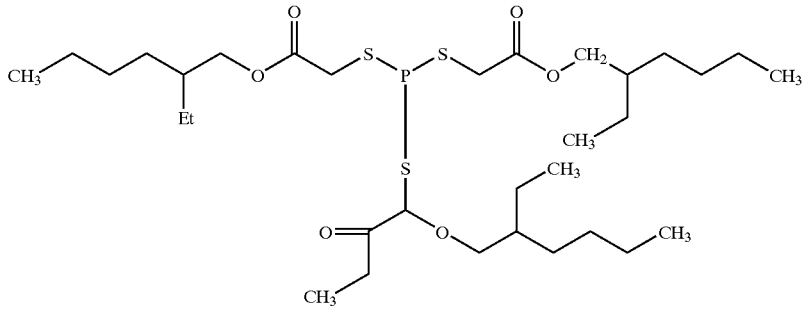

It must be noted that for the purposes of the present invention metal dihydrocarbyldithiophosphate (metal DDP) or ashless DDP do not fall within the above definition of sulfur-phosphorus containing anti-wear/extreme pressure additive because it has been found that they do not form crystals when combined with hindered phenols in base oils.

Hindered phenolic anti oxidants are also well known in the industry. Such materials include by way of example and not limitation 2,6-di-t-butyl to phenol, 2,6-di-t-butyl alkylated phenol where the alkyl substituent is hydrocarbyl and contains between 1 and 20 carbon atoms, such as 2,6-di-t-butyl-4-methyl phenol, 2,6-di-t-butyl-4-ethyl phenol, etc., or 2,6-di-t-butyl-4-alkoxy phenol where the alkoxy substituent contains between 1 and 20 carbons such as 2,6-di-t-butyl4-methoxyphenol; materials of the formula

II

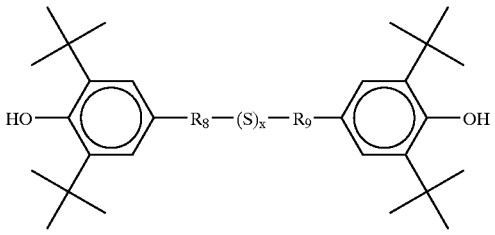

where X is zero to 5, $R_8$ and $R_9$ are the same or different and are $C_1$–$C_{20}$ hydrocarbyl which may contain oxygen or sulfur or be substituted with oxygen or sulfur containing groups; and materials of the formula

III

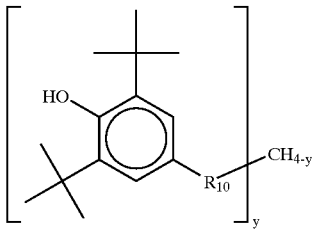

where y is 1 to 4 and $R_{10}$ is a $C_1$ to $C_{20}$ hydrocarbyl which may contain oxygen sulfur or nitrogen or be substituted with oxygen, sulfur or nitrogen containing groups such as 2,6 di tert butyl α dimethylamino P-cresol,

IV

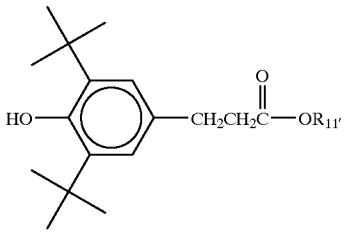

wherein it is believed $R_{11}$ is $C_8C_{17}$ (CAS # 125643-61-0), and mixtures of such phenolic type antioxidants.

Preferably the phenolic anti-oxidant contains an ester group, such as in formula IV above.

Phenolic type anti oxidants are typically used at a concentration of from about 0.01 to 2.0 wt %, preferably about 0.1 to 1.0 wt %, most preferably about 0.3 to 0.5 wt %, based on active ingredient.

In order to prevent or at least minimize the formation of crystals in lubricating oils based on base stock having less than 99% saturates preferably less than 98 wt % saturates and containing a mixture of sulfur-organo phosphorus anti-wear/extreme pressure additive and phenolic anti-oxidant, wherein the sulfur phosphorus containing anti-wear/extreme pressure agent interests with the hindered phenol to produce crystals a minor, crystal preventing effective amount of a high molecular weight carboxylic acid, anhydride or mixture thereof is added to the lubricating oil formulation.

The carboxylic acid or anhydride can be any high molecular weight acid such as di- or polycarboxylic acid, anhydride or mixture thereof of molecular weight of about 300–5000. Such acids, anhydrides or mixtures thereof include polyhydrocarbylene substituted di- or polycarboxylic acids or anhydrides wherein the poly hydrocarbylene group has a molecular weight in the range 300 to 5000, preferably 750 to 2000, most preferably 900 to 1000 (e.g., polyisobutylene) and wherein the carboxylic group is, e.g., succinic or maleic acid, anhydride or mixture thereof.

Poly hydrocarbylenes are homopolymer or interpolymers of polymerizable olefin group containing monomers having from 2 to 16 carbons. Interpolymers are those made using two or more different olefinic groups containing monomer including monomer such as styrenes. Poly hydrocarbylene homo and interpolymers are well known in the literature and to those skilled in the art and need not be further described herein.

Preferably the carboxylic acid or anhydride or mixture thereof used is polyalkylene succinic or maleic acid, anhydride, or mixtures thereof, most preferably polyisobutylene (PIB) succinic acid, anhydride or mixtures thereof wherein the PIB group has a molecular weight of about 900 to 1000.

Such high molecular weight carboxylic acids, anhydrides are employed in an amount in the range of about 0.0026 to 0.8 wt %, preferably about 0.08 to 0.4 wt %, most preferably about 0.12 to 0.24 wt %, based on active ingredients.

In general, at least 0.0013 wt % of high molecule weight carboxylic acid, anhydride or mixture thereof is used for each 1 ppm phosphorous from the sulfur-organo phosphorus anti-wear/extreme pressure agent.

EXAMPLES

Example 1

This example (Table 1) is presented to show that, in a base stock having a saturates content of less than 99 wt %, the combination of a sulfur-phosphorous anti-wear/extreme pressure agent with a hindered phenol results in crystal formation while the combination of a sulfur free phosphate extreme pressure agent and hindered phenol does not result in crystal formation.

TABLE 1

| | | | Crystals at 3 months |
|---|---|---|---|
| Base oil (1) | + .55 wt % sulfur-phosphorus extreme pressure agent (2) | + 0.4 wt % hindered phenol (3) | yes |
| Base oil (1) | + .4 wt % hindered phenol | + .55 wt % sulfur free phosphate EP agent (4) | no |

(1) solvent refined base oil, about 88% saturates 150 SN oil (2) sulfur phosphorus extreme pressure agent CAS #83547-95-9 which is 60% sulfur-phosphorus component active ingredient (also contained $C_4$–$C_8$ diphenyl amine as balance of additive)

(3) 100% active ingredient, CAS # 125643-61-0

(4) 100% active ingredient, isopropylated triaryl phosphate

The resulting lubricant had a phosphorus content of 120 ppm by weight, measured according to standard test ASTM D5185-97, attributable to the sulphur-phosphorus extreme pressure agent (which was the sole phosphorus-containing component contained in the lubricant formulation)

Example 2

This example (Table 2) is presented to show that crystal formation is eliminated in formulations normally exhibiting crystal formation by the addition of high molecular weight anhydride but that crystal formation is not eliminated by the addition of high molecular weight anhydride-poly amine dispersant, or by the addition of esters. All formulations tested in this example further contained typical pour point depressants, anti-rust agent and an amino para cresol anti-oxidant.

TABLE 2

| | | | | Crystals at 3 months |
|---|---|---|---|---|
| Base oil (1) | + .55 wt % sulfur-phosphorus EP agent (2) | + 0.4 wt % hindered phenol (3) | + _____ | yes |

TABLE 2-continued

| | | | | Crystals at 3 months |
|---|---|---|---|---|
| Base oil (1) | + .55 wt % sulfur-phosphorus EP agent (2) | + 0.4 wt % hindered phenol (3) | + PIBSA + PAM (4) | yes |
| Base oil (1) | + .55 wt % sulfur-phosphorus EP agent (2) | + 0.4 wt % hindered phenol (3) | + Esters (5) | yes |
| Base oil (1) | + .55 wt % sulfur-phosphorus EP agent (2) | + 0.4 wt % hindered phenol (3) | + PIBSA (6) | yes |
| Base oil (1) | + .55 wt % sulfur-phosphorus EP agent (2) | + 0.4 wt % hindered phenol (3) | + PIBSA (7) | no |

(1) Base oil, a 50/50 mixture of 150N (88% saturates) and 400N (about 78% saturates).
(2) See Table 1.
(3) See Table 1.
(4) PIBSA-PAM was tested at concentration of from 0.05 to .4 wt % and at all concentrations used crystals formed within the three month time period of the test.
(5) Esters tested were di iso nonyl phthalate at 0.05 to 4 wt %; di iso-tridecyl adipate at .1 to .5 wt %; $C_6$ and $C_{13}$ phthalate at .5 wt %. None were effective at eliminating crystal formation during the three month time period of the test.
(6) PIBSA is polyisobutylene succinic anhydride, having a polyisobutylene molecular weight of 950. When used at .04 wt % and .08 wt % active ingredient level, it did not eliminate crystal formation.
(7) PIBSA (of note 6) at .16 wt % and .32 wt % active ingredient level eliminated crystal formation.

Example 3

This example (Table 3) is presented to show the effect of base stock saturation on the suppression of crystal formation when using PIBSA in combination with sulfur phosphorus extreme pressure agent and hindered phenol.

TABLE 3

| | | | | Crystals at 3 months |
|---|---|---|---|---|
| Base oil (1) | + 0.55 wt % sulfur phosphorus extreme pressure agent (2) | + 0.4 wt % hindered phenol (3) | + 0.16 wt % PIBSA (4) | no |
| Base oil (5) | + 0.55 wt % sulfur phosphorus extreme pressure agent (2) | + 0.4 wt % hindered phenol (3) | + 0.16 wt % PIBSA (4) | no |
| Base oil (6) | + 0.55 wt % sulfur phosphorus extreme pressure agent (2) | + 0.4 wt % hindered phenol (3) | + 0.16 wt % PIBSA (4) | no |
| Base oil (7) | + 0.55 wt % sulfur phosphorus extreme pressure agent (2) | + 0.4 wt % hindered phenol (3) | + 0.16 wt % PIBSA (4) | no |
| Base oil (8) | + 0.55 wt % sulfur phosphorus extreme pressure agent (2) | + 0.4 wt % hindered phenol (3) | + 0.16 wt % PIBSA (4) | cloudy |
| Base oil (9) | + 0.55 wt % sulfur phosphorus extreme pressure agent (2) | + 0.4 wt % hindered phenol (3) | + 0.16 wt % PIBSA (4) | cloudy |
| Base oil (10) | + 0.55 wt % sulfur phosphorus extreme pressure agent (2) | + 0.4 wt % hindered phenol (3) | + 0.16 wt % PIBSA (4) | cloudy |
| Base oil (10) | + 0.55 wt % sulfur phosphorus extreme pressure agent (2) | + 0.4 wt % hindered phenol (3) | PIBSA @ .8% AI | yes |

(1) See Table 1.
(2) See Table 1.
(3) See Table 1.
(4) PIBSA is polyisobutylene succinic anhydride, polyisobutylene molecular weight 950.
(5) 150N, about 80% saturates.

TABLE 3-continued

| | | | | Crystals at 3 months |
|---|---|---|---|---|

(6) 150N FDA C grade white oil about 80% saturate (by clay-gel analysis-ASTM D 2007).
(7) Hydrocracked 90N, about 92% saturates.
(8) 150N FDA A grade white oil, 100% saturates
(9) Hydrocracked 150N, about 99.9% saturates.
(10) PAO-6, 100% saturates.

From this it is seen that in base oils having less than 99% saturates and containing mixtures of sulfur-phosphorus extreme pressure agent and hindered phenol, which are prone to crystal formation, crystal formation is surpressed on adding PIBSA where as in base oils of essentially 100% saturates content even addition of PIBSA failed to prevent crystal formation and even increasing PIBSA concentrate to 0.8 wt % (active ingredient) did not prevent crystal formation.

What is claimed is:

1. A lubricating oil of reduced crystal formation potential wherein the crystal formation is attributable to the interaction of sulfur-phosphorus containing anti-wear/extreme pressure agents and hindered phenolic antioxidants, the lubricating oil comprising a major amount of a base oil of lubricating viscosity and having less than about 99 wt % saturates content, and a minor amount of additive comprising a sulfur-phosphorus containing anti-wear/extreme pressure additive of the type which will interact with hindered phenol antioxidant to produce crystals, a hindered phenol antioxidant and a high molecular weight di- or poly-carboxylic acid, anhydride or mixture thereof provided at least 0.0013 wt % high molecular weight di- or poly-carboxylic acid, anhydride or mixture thereof is present for each 1 ppm phosphorus attributable to the sulfur-phosphorus containing anti-wear/extreme pressure agent.

2. The lubricating oil of claim 1 wherein the sulfur-phosphorus containing anti-wear/extreme pressure agent is in an amount sufficient to provide about 2 ppm to 320 ppm phosphorus, the hindered phenol antioxidants is at a concentration of from about 0.01 to 2.0 wt % based on active ingredient and the high molecular weight di- or poly-carboxylic acid anhydride or mixture thereof is at a concentration of in the range of about 0.0026 to 0.8 wt % based on active ingredient.

3. The lubricating oil of claim 1 wherein the sulfur-phosphorus containing anti-wear/extreme pressure agent is in an amount sufficient to provide from 40 ppm to 200 ppm phosphorus.

4. The lubricating of claim 1 wherein the sulfur-phosphorus containing anti-wear/extreme pressure agent is in an amount sufficient to provide from 80 ppm to 130 ppm phosphorus.

5. The lubricating oil of claim 1, 2, 3 or 4 wherein the hindered phenol is at a concentration of about 0.1 to 1.0 wt % based on active ingredient.

6. The lubricating oil of claim 1, 2, 3 or 4 wherein the hindered phenol is at a concentration of about 0.3 to 0.5 wt % based on active ingredient.

7. The lubricating oil of claim 2, 3 or 4 wherein the high molecular weight di- or poly-carboxylic acid, anhydride or mixture thereof is at a concentration of about 0.08 to 0.4 wt % based on active ingredient.

8. The lubricating oil of claim 3 or 4 wherein the high molecular weight di- or poly-carboxylic acid anhydride or mixture thereof is at a concentration of about 0.12 to 0.24 wt % based on active ingredient.

9. The lubricating oil of claim 1, 2, 3 or 4 wherein the high molecular weight di- or poly-carboxylic acid, anhydride or mixture thereof is a polyhydrocarbylene substituted di- or poly-carboxylic acid, anhydride or mixture thereof wherein the polyhydrocarbylene group has a molecular weight in the range of 300 to 5,000.

10. A method for reducing crystal formation in lubricating oil containing a mixture of sulfur-phosphorus anti-wear/extreme pressure agent and hindered phenol antioxidant wherein the production of the crystals is due to the interaction between the particular sulfur-phosphorus anti-wear/extreme pressure agent and the phenolic antioxidant, such method comprising adding to a mixture comprising a major amount of a base oil of lubricating viscosity having a saturates content of less than 99 wt % and a minor amount of additives comprising the particular sulfur-phosphorus containing anti-wear/extreme pressure agent and the hindered phenol antioxidant which otherwise interact to form crystals, a high molecular weight di- or poly-carboxylic acid, anhydride or mixture thereof provided at least 0.0013 wt % of the high molecular weight di- or poly-carboxylic acid, anhydride or mixture thereof is used for each 1 ppm phosphorus attributable to the sulfur-phosphorus containing anti-wear/extreme pressure agent.

11. The method of claim 10 wherein the sulfur-phosphorus anti-wear/extreme pressure agent is in an amount sufficient to provide about 2 ppm to 320 ppm phosphorus, the hindered phenol antioxidant is at a concentration of from about 0.01 to 2.0 wt % based on active ingredient and the high molecular weight di- or poly-carboxylic acid is at a concentration of in the range of about 0.0026 to 0.8 wt % based on active ingredient.

12. The method of claim 10 wherein the sulfur-phosphorus containing anti-wear/extreme pressure agent is in an amount sufficient to provide from 40 ppm to 200 ppm phosphorus.

13. The method of claim 10 wherein the sulfur-phosphorus containing anti-wear/extreme pressure agent is in an amount sufficient to provide from 80 ppm to 130 ppm phosphorus.

14. The method of claim 11, 12 or 13 wherein the high molecular weight di- or poly-carboxylic acid, anhydride or mixture thereof is at a concentration of about 0.08 to 0.4 wt % based on active ingredients.

15. The method of claim 12 or 13 wherein the high molecular weight di- or poly-carboxylic acid, anhydride or mixture thereof is at a concentration of about 0.12 to 0.24 wt % based on active ingredient.

16. The method of claim 10, 11, 12 or 13 wherein the hindered phenol is at a concentration of about 0.1 to 1.0 wt % based on active ingredient.

17. The method of claim 14 wherein the hindered phenol is at a concentration of about 0.1 to 1.0 wt % based on active ingredient.

18. The method of claim 15 wherein the hindered phenol is at a concentration of about 0.1 to 1.0 wt % based on active ingredient.

19. The method of claim 10, 11, 12 or 13 whew the hindered phenol is at a concentration of about 0.3 to 0.5 wt % based on active ingredient.

20. The method of claim 14 wherein the hindered phenol is at a concentration of about 0.3 to 0.5 wt % based on active ingredient.

21. The method of claim 15 wherein the hindered phenol is at a concentration of about 0.3 to 0.5 wt % based on active ingredient.

22. The method of claim 10, 11, 12 or 13 wherein the high molecular weight di- or poly-carboxylic acid, anhydride or mixtures thereof is a polyhydrocarbylene substituted di- or poly-carboxylic acid, anhydride or mixture thereof wherein the polyhydrocarbylene group has a molecular weight in the range 300 to 5,000.

23. The method of claim 17 wherein the high molecular weight di- or poly-carboxylic acid, anhydride or mixtures thereof is a polyhydrocarbylene substituted di- or poly-carboxylic acid, anhydride or mixture thereof wherein the polyhydrcarbylene group has a molecular weight in the range 300 to 5,000.

24. The method of claim 18 wherein the high molecular weight di- or poly-carboxylic acid, anhydride or mixtures thereof is a polyhydrocarbylene substituted di- or poly-carboxylic acid, anhydride or mixture thereof wherein the polyhydrocarbylene group has a molecular weight in the range 300 to 5,000.

25. The method of claim 20 wherein the high molecular weight di- or poly-carboxylic acid, anhydride or mixtures thereof is a polyhydrocarbylene substituted di- or poly-carboxylic acid, anhydride or mixture thereof wherein the polyhydrocarbylene group bas a molecular weight in the range 300 to 5,000.

26. The method of claim 21 wherein the high molecular weight di- or poly-carboxylic acid, anhydride or mixtures thereof is a polyhydrocarbylene substituted di- or poly-carboxylic acid, anhydride or mixture thereof wherein the polyhydrocarbylene group has a molecular weight in the range 300 to 5,000.

27. The lubricating oil of claim 7 wherein the high molecular weight di- or poly-carboxylic acid, anhydride or mixture thereof is a polyhydrocarbylene substituted di- or poly-carboxylic acid, anhydride or mixture thereof wherein the polyhydrocarbylene group has a molecular weight in the range of 300 to 5,000.

28. The lubricating oil of claim 8 wherein the high molecular weight di- or poly-carboxylic acid, anhydride or mixture thereof is a polyhydrocarbylene substituted di- or poly-carboxylic acid, anhydride or mixture thereof wherein the polyhydrocarbylene group has a molecular weight in the range of 300 to 5,000.

* * * * *